United States Patent [19]

Cole, Jr.

[11] Patent Number: 4,548,436

[45] Date of Patent: Oct. 22, 1985

[54] SECURITY LOCK FOR DOUBLE DOORS

[76] Inventor: Theodore M. Cole, Jr., Rte. 1, Box 385, Fishersville, Va. 22939

[21] Appl. No.: 641,068

[22] Filed: Sep. 26, 1984

Related U.S. Application Data

[63] Continuation of Ser. No. 430,530, Sep. 30, 1982, abandoned.

[51] Int. Cl.[4] ..... E05C 19/18

[52] U.S. Cl. ..... 292/292; 292/259 R

[58] Field of Search ..... 292/259 R, 259 A, 288, 292/289, 292

[56] References Cited

U.S. PATENT DOCUMENTS

| | | | |
|---|---|---|---|
| 193,549 | 7/1877 | Pope | 292/259 |
| 212,242 | 2/1879 | Loper, Jr. | 292/259 |
| 290,400 | 12/1883 | Coe | 292/292 |
| 633,078 | 9/1899 | Crane et al. | 292/292 |
| 698,326 | 4/1902 | Schwab | 292/259 X |
| 888,614 | 5/1908 | Hughes | 292/292 |
| 1,508,919 | 9/1924 | Cain et al. | 292/259 |
| 1,722,736 | 7/1929 | Derbyshire | 292/268 |
| 3,589,761 | 6/1971 | Lambert | 292/292 |
| 3,980,328 | 9/1976 | Pearson | 292/259 R X |
| 4,335,910 | 6/1982 | Massie | 292/259 R |
| 4,429,911 | 2/1984 | O'Neal et al. | 292/259 R |

*Primary Examiner*—Gary L. Smith
*Assistant Examiner*—Thomas J. Dubnicka
*Attorney, Agent, or Firm*—B. P. Fishburne, Jr.

[57] ABSTRACT

French doors or other double hinge doors are barred against inward opening by an intruder by placing a pair of apertured support brackets in the door jamb at the hinged edges of the double doors and allowing these brackets to be supported by resting on two door hinges. A section of 2×4 lumber or other bar member is then placed through apertures of the brackets and extends across the two doors to securely bar them.

2 Claims, 4 Drawing Figures

SECURITY LOCK FOR DOUBLE DOORS

This is a continuation of application Ser. No. 430,530, filed Sept. 30, 1982.

BACKGROUND OF THE INVENTION

The objective of this invention is to satisfy a need for a simple, secure and economical means for locking or barring French doors or other double hinged doors against intruders from the outside. A particular need for this device consists where homeowners are leaving the premises for relatively long periods and do not wish to rely solely on conventional door installed bolts and latches which in some instances can be forced open or otherwise defeated. With the present barring device properly installed, it becomes virtually impossible for an intruder to force the doors open under any circumstances.

Another important object of the invention is to provide a double door barring device which includes no permanent attachments to the doors or door frame, the parts making up the device being of such a nature that their temporary installation will not mar or otherwise damage even expensively finished doors.

Still another object is to provide a door locking arrangement of the above character which, during use, merely rests removably on a pair of door hinges at opposite sides of the doorway.

Other features and advantages of the invention will become apparent during the course of the following detailed description.

DETAILED DESCRIPTION

Figure 1:
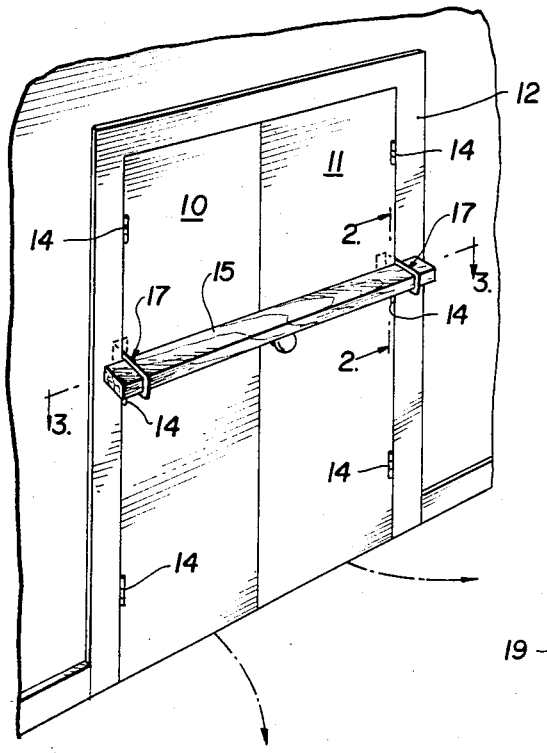
FIG. 1 is a perspective view of a double door security bar or lock according to the invention.
Figure 2:
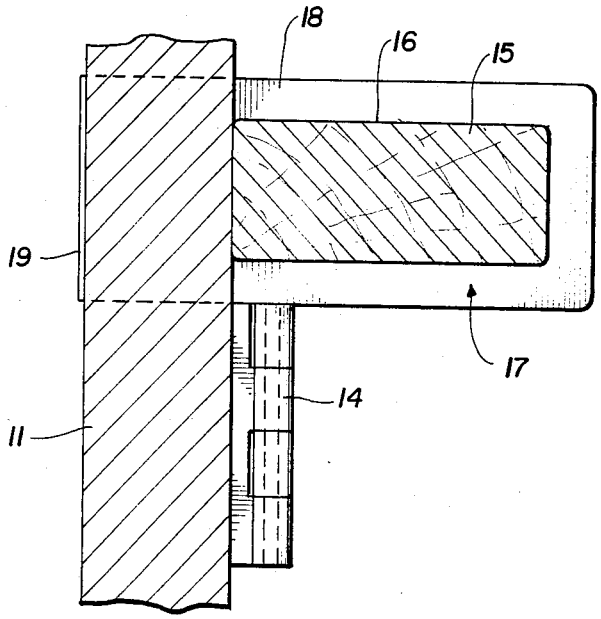
FIG. 2 is an enlarged fragmentary vertical section taken on line 2—2 of FIG. 1.
Figure 4:
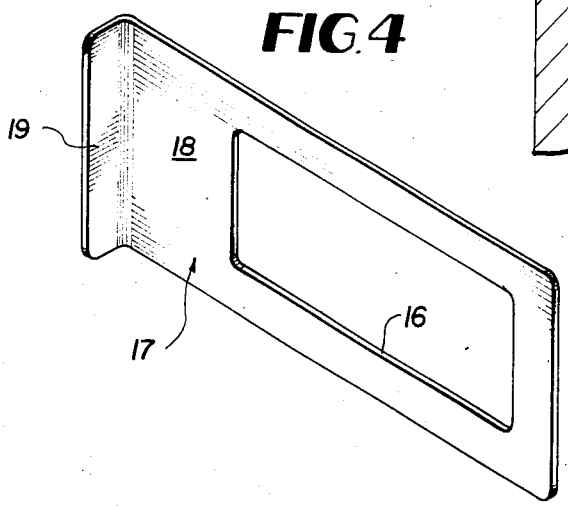
FIG. 4 is a perspective view of a door bar support bracket.
Figure 3:
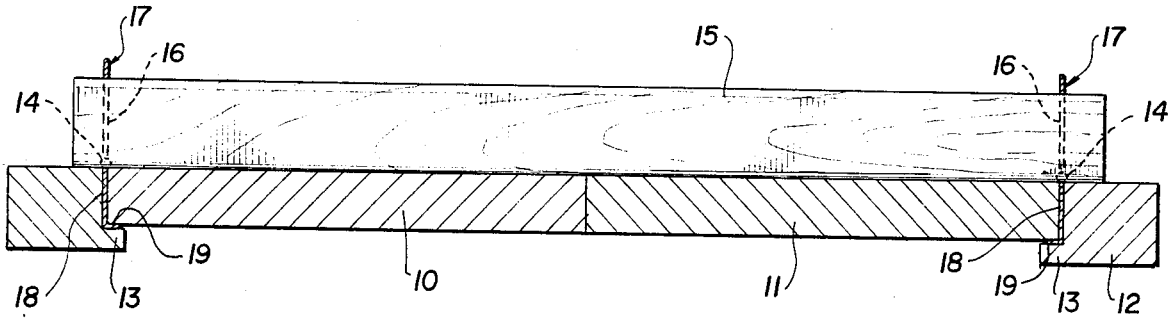
FIG. 3 is a horizontal section taken on line 3—3 of FIG. 1.

Referring to the drawings in detail wherein like numerals designate like parts, the numerals 10 and 11 designate French doors or other double hinged doors within a conventional door frame 12 having stop rails 13 for the doors, the two doors opening inwardly as shown by the arrows in FIG. 1. The doors 10 and 11 are hung on conventional hinges 14 at the interior side of the door frame. The doors may be equipped with any conventional locking or bolting means, not shown, including vertical or horizontal bolts or a keylock set. In this connection the present invention is an added security measure which renders it virtually impossible to force entry through double doors even if conventional locking devices are defeated.

The device proper comprises a simple bar element 15, such as a cut section of 2×4 lumber which is inserted through apertures 16 in a pair of identical bar supporting brackets 17 preferably formed of stainless steel or equivalent strong material. Each bracket 17 includes a thin flat plate body 18 containing the aperture 16 near its interior end and the bracket has a relatively narrow inwardly turned right angular flange or lip 19 at its outer end.

In use, the doors 10 and 11 are opened inwardly to separate their hinged edges from the stops 13 and adjacent jamb surfaces of the door frame. The brackets 17 are installed as illustrated with their lower longitudinal edges resting on and supported by the tops of one pair of hinges 14. The flanges 19 are disposed between the stops 13 and the outer faces of the two doors when the doors are returned to their closed positions where their conventional locks or bolts may be activated. The plate portions 18 project inwardly of the two doors as shown and the apertures 16 are in alignment at the interior sides of the doors so that the bar 15 can merely be slipped through the apertures and supported by the two brackets 17 in the door barring or locking position. Preferably, the bar 15 is substantially in direct contact with the interior faces of the two doors.

It will be appreciated that the arrangement does not mar or damage the doors or door frame in any way, requires no screws, nails or other fasteners, and consequently no drilling or cutting of the doors or door frame. The entire device rests by gravity on the two hinges 14, is merely a temporary installation, and can be separated from the doorway and conveniently stored when the homeowner returns to the premises. The arrangement forms a practical, convenient, secure and very inexpensive night locking arrangement for double doors which form an entranceway to a home or other building.

The device is not limited to the use of a rectangular cross section bar or rectangular apertures 16 and these elements may have other shapes and sizes, provided that a sturdy bar member can be placed across the two doors substantially against their interior faces in such a manner that the bar cannot be removed from its two supporting brackets by a lateral force against the bar but only by endwise movement of the bar relative to the brackets.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A security assembly comprising a door frame including vertical stop rails on the opposite sides of the frame, the frame having exterior and interior vertical faces, the stop rails being adjacent to the exterior face of the door frame, a pair of horizontal swingable doors within the door frame and having interior faces which are flush with the interior face of the door frame when the doors are closed, the doors having exterior faces which are in close opposing relationship to the stop rails when the doors are closed, vertical axis hinges swingably securing the doors to the opposite sides of the door frame and being arranged in horizontally aligned pairs and the hinges projecting beyond the interior face of the door frame, a pair of identical thin flat bracket plates which are elongated horizontally during use disposed between the outer vertical edges of the doors and the sides of the door frame and projecting inwardly of the interior face of the door frame substantially at right angles thereto, the bracket plates having lower horizontal edges resting on the tops of one horizontally aligned pair of the hinges, said bracket plates having openings formed therethrough in their portions projecting inwardly of the interior face of the door frame and the openings having edges which are substantially flush with the interior face of the door frame, short right angular vertical flanges on the exterior ends of the bracket plates extending from the bracket plates toward the center of the door frame, the flanges overlapping the exterior faces of the doors adjacent to the stop rails and lying between the exterior faces of the doors and stop rails whereby the bracket plates are captively held in use positions, and a single elongated horizontal locking bar engaging through the openings of the bracket plates and horizontally spanning the interior faces of the doors in substantial contact therewith when the doors are closed and having end portions in overlapping engagement with the interior face of the door frame at the opposite sides of the door frame.

2. A security assembly as defined in claim 1, and said bracket plates being substantially rectangular, and said openings being substantially rectangular and being elongated along the axis of elongation of the bracket plates, and said locking bar comprising a length of rectangular cross section lumber.

* * * * *